US008764537B2

(12) United States Patent
Jaffe et al.

(10) Patent No.: US 8,764,537 B2
(45) Date of Patent: Jul. 1, 2014

(54) WAGERING GAME WITH SYMBOLS COLLECTION

(75) Inventors: Joel R. Jaffe, Glenview, IL (US); William Wadleigh, Lisle, IL (US)

(73) Assignee: WMS Gaming Inc., Waukegan, IL (US)

( * ) Notice: Subject to any disclaimer, the term of this patent is extended or adjusted under 35 U.S.C. 154(b) by 2712 days.

(21) Appl. No.: 11/238,326

(22) Filed: Sep. 29, 2005

(65) Prior Publication Data

US 2006/0068893 A1 Mar. 30, 2006

Related U.S. Application Data

(60) Provisional application No. 60/614,251, filed on Sep. 29, 2004.

(51) Int. Cl.
*A63F 9/24* (2006.01)

(52) U.S. Cl.
USPC ..... 463/16; 463/20; 463/24; 273/138.1

(58) Field of Classification Search
USPC ..... 463/16–25; 273/138.1, 139
See application file for complete search history.

(56) References Cited

U.S. PATENT DOCUMENTS

| | | | | |
|---|---|---|---|---|
| 4,752,068 | A | 6/1988 | Endo | |
| 5,575,474 | A | 11/1996 | Rossides | |
| 5,609,525 | A | 3/1997 | Ohno et al. | |
| 5,833,537 | A | 11/1998 | Barrie | |
| 5,947,820 | A * | 9/1999 | Morro et al. | 463/9 |
| 5,957,775 | A | 9/1999 | Cherry | |
| 6,004,211 | A | 12/1999 | Brenner et al. | |
| 6,012,045 | A | 1/2000 | Barzilai | 705/37 |
| 6,012,983 | A | 1/2000 | Walker et al. | |
| 6,015,344 | A | 1/2000 | Kelly et al. | 463/16 |
| 6,068,553 | A | 5/2000 | Parker | 463/27 |
| 6,077,163 | A | 6/2000 | Walker et al. | |
| 6,113,098 | A | 9/2000 | Adams | |
| 6,165,071 | A | 12/2000 | Weiss | |
| 6,203,430 | B1 * | 3/2001 | Walker et al. | 463/20 |
| 6,234,896 | B1 | 5/2001 | Walker et al. | |
| 6,254,481 | B1 | 7/2001 | Jaffe | 463/20 |
| 6,270,412 | B1 * | 8/2001 | Crawford et al. | 463/20 |
| 6,273,820 | B1 | 8/2001 | Haste, III | |
| 6,302,790 | B1 | 10/2001 | Brossard | 463/20 |
| 6,311,976 | B1 | 11/2001 | Yoseloff et al. | 273/138 |

(Continued)

FOREIGN PATENT DOCUMENTS

| | | | |
|---|---|---|---|
| WO | WO 99/29381 | 6/1999 | |
| WO | WO 2005/082480 A1 | 9/2005 | A63F 13/00 |

(Continued)

*Primary Examiner* — William Brewster
*Assistant Examiner* — Alex F. R. P. Rada, II
(74) *Attorney, Agent, or Firm* — Nixon Peabody LLP

(57) ABSTRACT

Wagering game terminal and method of operating same are disclosed in which players collect symbols and/or symbol combinations that are indicative of a randomly selected outcome. The symbols and/or symbol combinations may be collected anytime they appear on the wagering game terminal, or they may be collected only if they appear in a certain manner or at a certain time. Players who manage to complete a predefined collection of symbols and/or symbol combinations are awarded a special event game, such as a bonus game, a jackpot, and the like. The players may carry over the symbols and/or symbol combinations they have collected across multiple gaming sessions and multiple gaming terminals. In this way, the players may retain the benefit of their previous gaming experiences.

29 Claims, 8 Drawing Sheets

(56) References Cited

U.S. PATENT DOCUMENTS

| | | | | |
|---|---|---|---|---|
| 6,319,127 | B1 | 11/2001 | Walker et al. | |
| 6,364,765 | B1 | 4/2002 | Walker et al. | |
| 6,364,766 | B1 | 4/2002 | Anderson et al. | 463/16 |
| 6,365,765 | B1 | 4/2002 | Baldwin et al. | |
| 6,431,983 | B2 | 8/2002 | Acres | |
| 6,506,117 | B2 | 1/2003 | DeMar | 463/20 |
| 6,506,118 | B1 | 1/2003 | Baerlocher et al. | 463/25 |
| 6,663,489 | B2 | 12/2003 | Baerlocher | 463/20 |
| 6,722,981 | B2 | 4/2004 | Kaminkow | 463/20 |
| 6,722,985 | B2 | 4/2004 | Criss-Puszkiewicz et al. | 463/29 |
| 6,745,236 | B1 | 6/2004 | Hawkins et al. | 709/203 |
| 6,758,757 | B2 | 7/2004 | Luciano, Jr. et al. | |
| 6,776,713 | B2 | 8/2004 | Gauselmann | |
| 6,780,111 | B2 | 8/2004 | Cannon et al. | 463/25 |
| 6,800,027 | B2 | 10/2004 | Giobbi et al. | |
| 6,811,486 | B1 | 11/2004 | Luciano, Jr. | |
| 6,923,721 | B2 | 8/2005 | Luciano et al. | |
| 7,182,690 | B2 | 2/2007 | Giobbi et al. | 463/24 |
| 2001/0024971 | A1 | 9/2001 | Brossard | 463/30 |
| 2001/0046893 | A1 * | 11/2001 | Giobbi et al. | 463/24 |
| 2002/0028708 | A1 | 3/2002 | Busch et al. | 463/42 |
| 2002/0039919 | A1 | 4/2002 | Joshi et al. | 463/20 |
| 2002/0077173 | A1 | 6/2002 | Luciano, Jr. et al. | 463/23 |
| 2002/0077174 | A1 | 6/2002 | Luciano et al. | |
| 2002/0093136 | A1 | 7/2002 | Moody | |
| 2002/0094871 | A1 | 7/2002 | Luciano, Jr. et al. | 463/43 |
| 2002/0107065 | A1 | 8/2002 | Rowe | |
| 2002/0151349 | A1 | 10/2002 | Joshi | 463/20 |
| 2002/0196342 | A1 | 12/2002 | Walker et al. | 348/157 |
| 2003/0013515 | A1 | 1/2003 | Rowe et al. | |
| 2003/0013531 | A1 | 1/2003 | Rowe et al. | |
| 2003/0036422 | A1 | 2/2003 | Baerlocher et al. | 463/20 |
| 2003/0036427 | A1 | 2/2003 | Brandstetter et al. | |
| 2003/0064794 | A1 | 4/2003 | Mead et al. | 463/25 |
| 2003/0078101 | A1 | 4/2003 | Schneider et al. | |
| 2003/0100362 | A1 | 5/2003 | Horniak et al. | |
| 2003/0106769 | A1 | 6/2003 | Weiss | 463/21 |
| 2003/0114219 | A1 | 6/2003 | McClintic | |
| 2003/0119579 | A1 | 6/2003 | Walker et al. | 463/20 |
| 2003/0157979 | A1 | 8/2003 | Cannon et al. | |
| 2003/0195024 | A1 | 10/2003 | Slattery | 463/9 |
| 2003/0211881 | A1 | 11/2003 | Walker et al. | 463/20 |
| 2004/0053680 | A1 | 3/2004 | Schultz | 463/20 |
| 2004/0142742 | A1 | 7/2004 | Schneider et al. | |
| 2004/0209662 | A1 | 10/2004 | Wadleigh | 463/16 |
| 2005/0159207 | A1 | 7/2005 | Thomas | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/20 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0113770 | A1 | 5/2008 | Gelber et al. | 463/25 |

FOREIGN PATENT DOCUMENTS

| | | | | |
|---|---|---|---|---|
| WO | WO 2006/002241 | A2 | 1/2006 | A63F 13/00 |
| WO | WO 2006/004831 | A2 | 1/2006 | A63F 13/00 |
| WO | WO 2006/004832 | A2 | 1/2006 | A63F 13/00 |
| WO | WO 2006/005073 | A2 | 1/2006 | |
| WO | WO 2006/017036 | A1 | 2/2006 | A63F 13/00 |
| WO | WO 2006/017067 | A1 | 2/2006 | A63F 13/00 |
| WO | WO 2006/017068 | A1 | 2/2006 | A63F 13/00 |
| WO | WO 2006/020811 | A2 | 2/2006 | A63F 9/24 |
| WO | WO 2006/026250 | A2 | 3/2006 | |
| WO | WO 2006/044252 | A2 | 4/2006 | A63F 9/24 |
| WO | WO 2007/103054 | A2 | 9/2007 | G06F 19/00 |
| WO | WO 2008/048634 | A2 | 4/2008 | A63F 13/06 |

* cited by examiner

WAGERING GAME WITH SYMBOLS COLLECTION

CROSS-REFERENCE TO RELATED APPLICATION

This application claims priority to, and hereby incorporates by reference, U.S. Provisional Application No. 60/614,251, entitled "Wagering Game with Symbols Collection," filed Sep. 29, 2004, with the United States Patent and Trademark Office.

FIELD OF THE INVENTION

The present invention relates generally to wagering game terminals and, more particularly, to wagering game terminals where players retain the benefit of their previous gaming experiences.

BACKGROUND OF THE INVENTION

Wagering game terminals, such as slot machines, video poker machines, and the like, have been a cornerstone of the gaming industry for several years. The popularity of such wagering game terminals among players generally depends on the perceived likelihood of winning money at the terminal and the intrinsic entertainment value of the terminal relative to other available gaming options. Where the available gaming options include a number of competing terminals and the expectation of winning each terminal is roughly the same (or believed to be the same), players are likely to be attracted to the more entertaining and exciting of the terminals.

Consequently, wagering game terminal operators strive to employ the most entertaining and exciting terminals available because such terminals attract frequent play and, hence, increase profitability for the operators. Thus, in the highly competitive wagering game terminal industry, there is a continuing need to develop new types of games, or improvements to existing games, that will enhance the entertainment value and excitement associated with the games.

One concept that has been successfully employed in existing wagering game terminals to enhance player entertainment is the use of progressive games. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been employed is that of a secondary or "bonus" game which may be played in conjunction with a "basic" game. The bonus game may include any type of game, either similar to or entirely different from the basic game, and is typically initiated by the occurrence of certain pre-selected events or outcomes of the basic game. Examples of the types of bonus games may include adventure games, guessing games, games of chance, and the like. Such a bonus game has been found to produce a significantly higher level of player excitement than the basic game alone because it provides an additional chance to play, which increases the player's overall expectation of winning.

In current wagering game terminals, whether in a basic game or bonus game, once a player leaves a gaming session, he or she has to start from the beginning in the next gaming session. Typically, upon termination of play, the player is awarded the balance of any credits, but also loses any unused or unredeemed game assets that he or she may have accumulated. Further, any selections the player may have made, for example, any paths the player may have taken or options he or she may have chosen during the game, are reset so that there are no indications of where the player has been or what he or she has done.

Thus, there is a need for wagering game terminals that allow players to benefit from their previous experiences playing at the wagering game terminals.

SUMMARY OF THE INVENTION

The present invention is directed to a wagering game terminal and method for operating same where players retain the benefit of their previous gaming experiences. The invention involves players at the wagering game terminal collecting symbols and/or symbol combinations that are indicative of a randomly selected outcome. The symbols and/or symbol combinations may be collected anytime they appear on the wagering game terminal, or they may be collected only if they appear in a certain manner or at a certain time. Players who manage to complete a predefined collection of symbols and/or symbol combinations are awarded a special event game, such as a bonus game, a jackpot, and the like. The players may carry over the symbols and/or symbol combinations they have collected across multiple gaming sessions and multiple gaming terminals. In this way, the players may retain the benefit of their previous gaming experiences.

In general, in one aspect, the invention is directed to a wagering game terminal. The wagering game terminal comprises a wager input device for receiving wager inputs at the wagering game terminal, the wagers applied to a wagering game in which outcomes are randomly selected from a plurality of outcomes. The wagering game terminal further comprises a display for displaying symbols indicative of each randomly selected outcome. The symbols include special event symbols that are added to a special event collection in response to the special event symbols being displayed on the display in a predetermined manner. The completion of the special event collection triggers a special event on the wagering game terminal. The wagering game terminal is configured to store special event symbols that have been added to the special event collection upon conclusion of a current gaming session, and to restore previously stored special event symbols to the special event collection in a subsequent gaming session.

In general, in another aspect, the invention is directed to a method of operating a wagering game terminal. The method comprises accepting wagers at the wagering game terminal, the wagers applied to a wagering game in which outcomes are randomly selected from a plurality of outcomes. The method further comprises displaying symbols indicative of each randomly selected outcome on a display, the symbols including special event symbols. The special event symbols are added to a special event collection if the special event symbols are displayed on the display in a predetermined manner. The special event symbols that have been added to the special event collection are stored upon conclusion of a current gaming session, and previously stored special event symbols are restored to the special event collection in a subsequent gaming session. The special event collection triggers a special event on the wagering game terminal in the subsequent gaming session when the special event collection is complete.

In general, in yet another aspect, the invention is directed to a wagering game network. The wagering game network comprises a network server and a plurality of wagering game terminals connected to the network server. Each wagering game terminal is configured to display symbols indicative of a randomly selected outcome. The symbols include special event symbols that are added to a special event collection in response to the special event symbols appearing on the wagering game terminal in a predetermined manner. The network server is configured to save information from the plurality of wagering game terminals regarding the special event symbols and to restore to the plurality of wagering game terminals previously saved information regarding the special event symbols.

In general, in still another aspect, the invention is directed to a method of operating a wagering game terminal. The method comprises displaying symbols indicative of a randomly selected outcome, the symbols including special event symbols. The method further comprises adding the special event symbols to a special event collection if the special event symbols are displayed in a predetermined manner. The special event collection may be completed over multiple gaming sessions without restarting the special event collection. The completion of the special event collection triggers a special event on the wagering game terminal.

The above summary of the present invention is not intended to represent each embodiment or every aspect of the present invention. The detailed description and figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
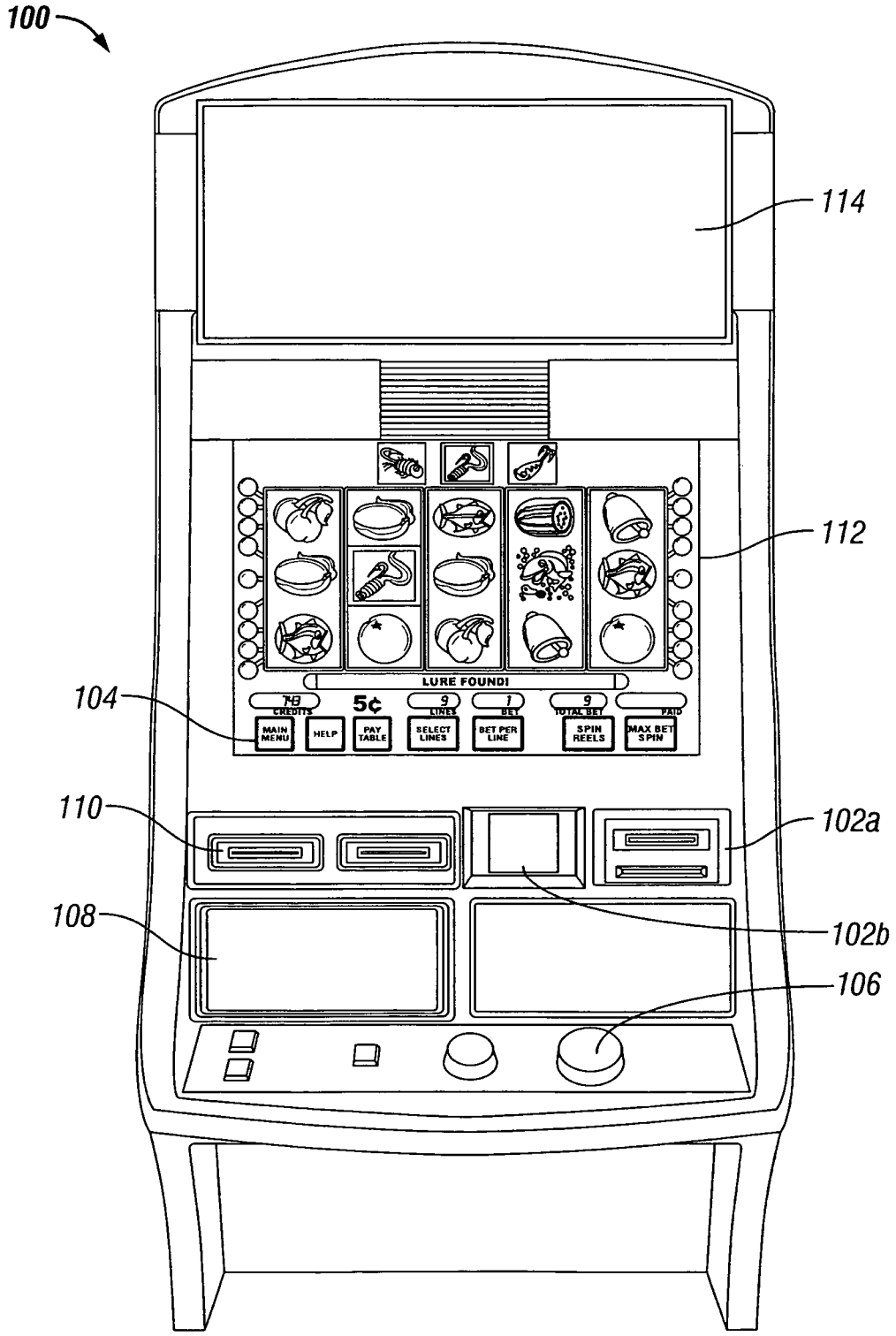
FIG. 1 illustrates a wagering game terminal according to one embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above, embodiments of the invention provide a wagering game terminal and method for operating same where players may collect game symbols and symbol combinations. Such an arrangement allows the players to benefit from their previous experiences playing at the wagering game terminals.

FIG. 1 shows a perspective view of an exemplary wagering game terminal 100 according to embodiments of the invention. The wagering game terminal 100 may be operated as a stand-alone terminal, or it may be connected to a network of wagering game terminals. Further, the wagering game terminal 100 may be any type of wagering game terminal and may have varying structures and methods of operation. For example, the wagering game terminal 100 may be a mechanical wagering game terminal configured to play mechanical slots, or it may be an electromechanical or electrical wagering game terminal configured to play a video casino game, such as blackjack, slots, keno, poker, etc. In the example shown, the wagering game terminal 100 is a video slot machine.

As shown, the wagering game terminal 100 includes input devices, such as a wager acceptor 102 (shown as a card wager acceptor 102*a* and a cash wager accepter 102*b*), a touch screen 104, a push-button panel 106, a payout mechanism 108, and an information reader 110. The wagering game terminal 100 further includes a main display 112 for displaying information about the basic wagering game and, in some embodiments, a secondary display 114 for displaying a pay table and/or game-related information or other entertainment features. While these typical components found in the wagering game terminal 100 are described briefly below, it should be understood that numerous other elements may exist and may be used in any number of combinations to create variation of the wagering game terminal 100.

The wager acceptors 102*a* and 102*b* may be provided in many forms, individually or in combination. For example, the cash wager acceptor 102*a* may include a coin slot acceptor or a note acceptor to input value to the wagering game terminal 100. The card wager acceptor 102*b* may include a card-reading device for reading a card that has a recorded monetary value with which it is associated. The card wager acceptor 102*b* may also receive a card that authorizes access to a central account that can transfer money to the wagering game terminal 100.

The payout mechanism 108 performs the reverse function of the wager acceptors 102*a* and 102*b*. For example, the payout mechanism 108 may include a coin dispenser or a note dispenser to dispense money or tokens from the wagering game terminal 100. The payout mechanism 108 may also be adapted to receive a card that authorizes the wagering game terminal 100 to transfer credits from the wagering game terminal 100 to a central account.

The push button panel 106 is typically offered, in addition to the touch screen 104, to provide players with an option on making their game selections. Alternatively, the push button panel 106 may facilitate player input needed for certain aspects of operating the game, while the touch screen 104 facilitates player input needed for other aspects of operating the game.

A set of symbols representing the outcome of the basic wagering game is displayed to the player on the main display 112. The main display 112 may take a variety of forms, including a cathode ray tube (CRT), a high resolution LCD, a plasma display, LED, or any other type of video display suitable for use in the wagering game terminal 100. As shown here, the main display 112 also includes the touch screen 104 overlaying the entire display (or a portion thereof) to allow players to make game-related selections. Alternatively, the wagering game terminal 100 may include a number of mechanical reels that display the symbols representing the game outcome.

In some embodiments, the information reader 110 is a card reader that allows for identification of a player by reading a card with information indicating the player's identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 110, which allows the casino's computers to register that player's wagering at the wagering game terminal 100. Then, the wagering game terminal 100 may use the secondary display 114 for providing the player with information about his or her account or other player-specific information. Also, in some embodiments, the information reader 110 may be used to restore assets that the player achieved during a previous gaming session and had saved.

Figure 2:
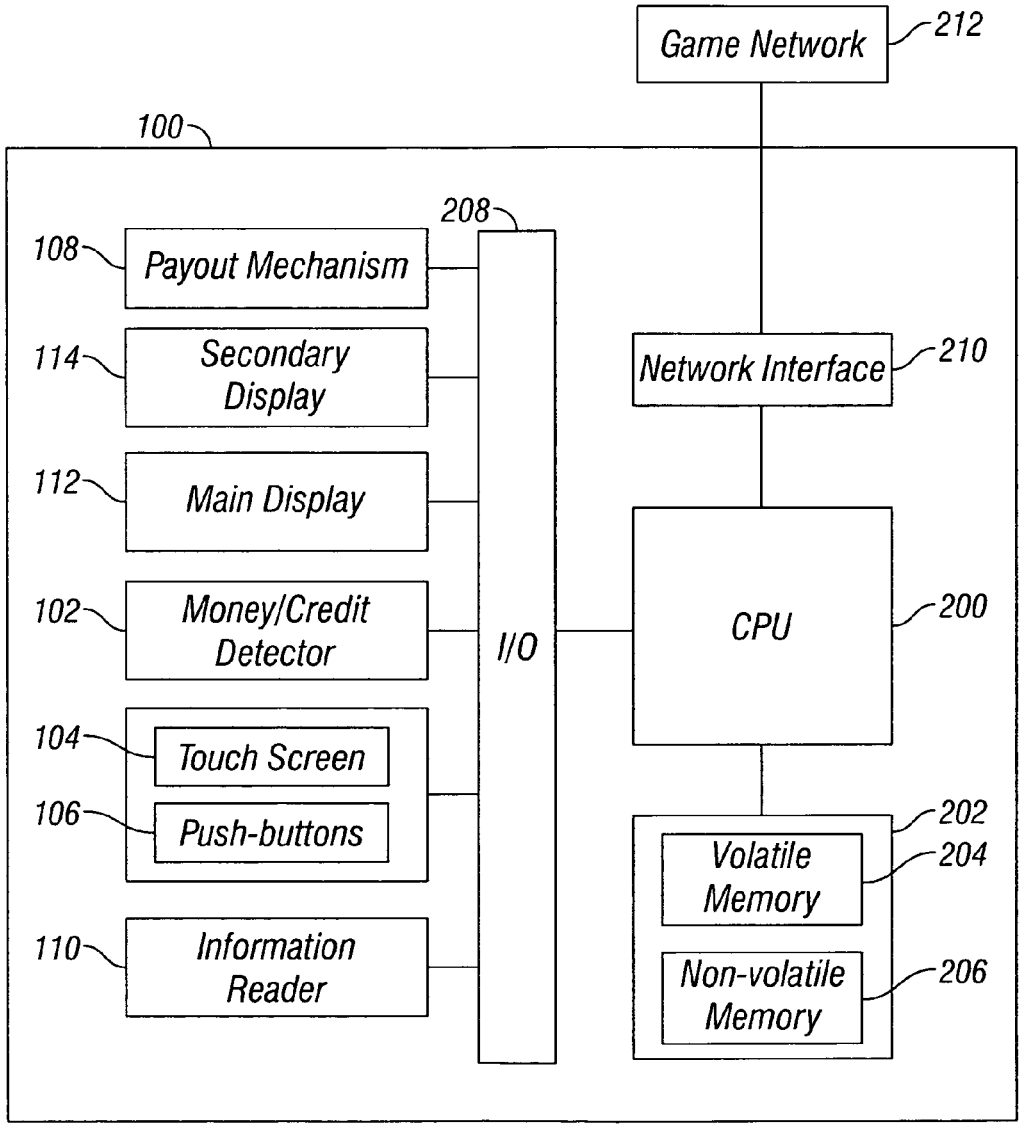
FIG. 2 illustrates the wagering game terminal of FIG. 1 in more detail.

As shown in FIG. 2, the various components of the wagering game terminal 100 are controlled by a central processing unit (CPU) 200, such as one or more microprocessors or microcontrollers. To provide the gaming functions, the CPU 200 executes a game program that generates a randomly selected game outcome. The CPU 200 is also coupled to or includes a local memory 202. The local memory 202 may be in the form of one or more volatile memories 204 (e.g., a random-access memory (RAM)) and one or more non-volatile memories 206 (e.g., an EEPROM).

Communication between the peripheral components of the wagering game terminal 100 and the CPU 200 is controlled by the CPU 200 through input/output (I/O) circuits 208. The CPU 200 also communicates with external systems via a network interface unit 210. Although the I/O circuit 208 and network interface unit 210 are shown here as individual components, it should be appreciated that both of these units may include a number of different types of components.

Figure 3:
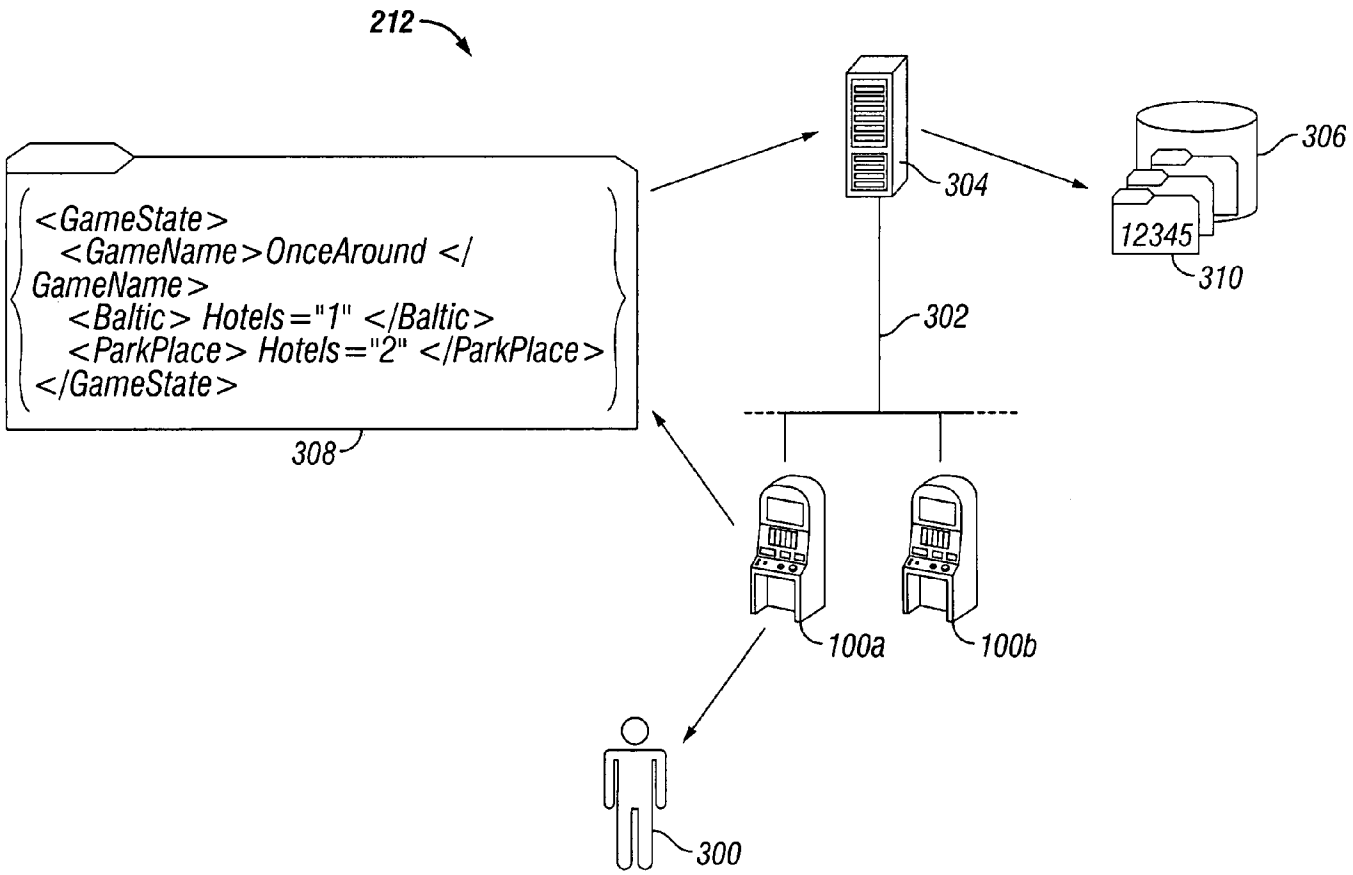
FIG. 3 illustrates a network to which the wagering game terminal of FIG. 1 may be connected.

As alluded to above, the wagering game terminal 100 may be a stand-alone terminal, or it may be part of a network 212 that connects multiple wagering game terminals 100 together. FIG. 3 illustrates the network 212 in more detail, including a plurality of wagering game terminals 100*a* and 100*b* connected via an Ethernet-TCP/IP connection 302 to a network server 304. The wagering game terminals 100*a* and 100*b* are similar to the wagering game terminal 100 (FIG. 1) in that they have many of the same features and components. In addition, one or more functions of the CPU 200 (FIG. 2) in the terminals 100*a* and 100*b* may reside on the network server 304 instead of, or in addition to, the wagering game terminal 100. The network server 304 may then conduct the basic and/or bonus games (or portions thereof) in place of the CPU 200 for each of the wagering game terminals 100*a* and 100*b* connected to the network 212, including providing the input data and information needed to operate the basic and/or bonus games.

The network server 304 may also control the progressive jackpots mentioned previously that are contributed to by all or some of the wagering game terminals 100*a* and 100*b* in the network 212 (e.g., terminal-level jackpots that only each terminal 100*a* or 100*b* contributes to, bank-level jackpots that are contributed to by all of the terminals 100*a* and 100*b* in a particular bank, and wide-area jackpots that are contributed to by a larger number of terminals 100*a* and 100*b*, such as multiple banks).

In addition, in accordance with embodiments of the invention, the network 212 allows players playing at one of the wagering game terminals 100*a* or 100*b* to store game assets that they may have accumulated for subsequent retrieval at a later time. The game assets may be any aspect of a basic and/or bonus game, whether tangible or intangible, that a player may win or accumulate, including, but not limited to, symbols and symbol combinations, monetary or non-monetary awards, features or characteristics of a game (e.g., a wild symbol, free spins, etc.), features or characteristics of a player (e.g., extra lives, strength, skills, intelligence, equipment, etc.), a bonus game, and the like. By allowing the players to retain their game assets when they depart, the players are given much incentive to return to the wagering game terminals 100*a* and 100*b* at a later time.

In some embodiments, the game asset information may be retained through a "ticket-in-ticket-out" (TITO) system on the network 212. The TITO system issues each player a ticket when the player departs a wagering game terminal 100*a* or 100*b*, which ticket can be used later to retrieve all the assets that the player has accumulated in the current game. Then, when the player returns to any wagering game terminal 100*a* or 100*b* on the network 212, he or she may retrieve his or her game asset information by presenting the ticket. An exemplary implementation of a TITO system is described below.

Referring still to FIG. 3, when a player 300 is ready to cash out of any wagering game terminal 100*a* or 100*b* on the network 212, the player 300 may request a ticket for his or her current game. Upon receiving such a request, the wagering game terminal 100*a* or 100*b* terminates the game and generates a game-specific file 308 in which it stores various information about the game. For example, the game-specific file 308 may identify the game played, wagering game terminal used, game assets accumulated, and other similar information. The game-specific file 308, which may be a text file, XML file, or other suitable format, is then forwarded over the Ethernet-TCP/IP connection 302 to the server 304.

The server 304 creates a game record 310 for the game-specific file 308 in a database 306 connected to, or residing within, the server 304 and generates a unique identifier for the game record 310. The unique identifier preferably is independent of the player's identification such that the player may remain anonymous to the network 212 and the wagering game terminal 100*a* or 100*b*, but it is also possible to use an identity-based identifier. The server 304 then sends the unique identifier back to the wagering game terminal 100*a* or 100*b*. The wagering game terminal 100*a* or 100*b* subsequently issues the player 300 a ticket, which may be a paper ticket (e.g., barcode) or an electronic ticket (e.g., magnetic), containing the unique identifier. For paper tickets, the ticket may be issued through the information reader 110 or any other suitable means commonly used for issuing such tickets.

When the player 300 subsequently returns to one of the wagering game terminals 100*a* or 100*b*, he or she may present the ticket to the information reader 110 to retrieve his or her accumulated asset and game selection information. The wagering game terminal 100*a* or 100*b* may be any wagering game terminal on the network 212, including the same wagering game terminal that the player 300 played on previously or a wagering game terminal that is not even in the same casino.

Upon receiving the ticket, the wagering game terminal 100*b* or 100*b* sends a request to the server 304 to retrieve the game record 310 that corresponds to the unique identifier of the ticket. If the server 304 determines that the ticket is valid (i.e., the unique identifier matches an unclaimed game record 310), it retrieves the corresponding game record 310 and sends the information contained therein back to the wagering game terminal 100*a* or 100*b*. The server 304 thereafter either deletes the game record 310 or marks it as "claimed" so that it is not reused. The terminal 100*a* or 100*b* then configures itself according to the game asset information received from the server 304.

In embodiments where the wagering game terminal 100*a* or 100*b* is a stand-alone terminal that is not connected to the network 212, the game record 310 may be created by the CPU 200 (FIG. 2) and stored in the local memory 202 of the wagering game terminal instead of on the network 212. Then, when the player 300 returns to the same stand-alone wagering game terminal to present his or her ticket (e.g., via the information reader 110), the appropriate game record 310 may be retrieved based on the unique identifier on the ticket. The CPU 200 thereafter restores the player's game asset information along with any other information (e.g., wagering game terminal, game, etc.) that was stored in the game record 310. This allows the player to retain the benefit of his or her earlier efforts, thereby increasing the player's interest and commitment to the wagering game.

In some embodiments, instead of a ticket, the information reader 110 may include a card reader, and the unique identifier provided by the wagering game terminal 100*a* or 100*b* may be stored on a player's personal identification card. It is also possible to store the entire game-specific file 308 on the player's personal identification card instead of just the unique identifier. Or, the wagering game terminal 100*a* or 100*b* may include a radio frequency identification device (RFID) transceiver or receiver (not shown) such that an RFID transponder held by the player can be used to provide the unique identifier at the wagering game terminal 100*a* or 100*b* without the need to insert a card into the information reader 110. RFID components can be those available from Pacific Northwest National Laboratory (under the United States Department of Energy) of Richland, Wash.

In some embodiments, the information reader 110 may also include a biometric reader, such as a finger, hand, or retina scanner, and the unique identifier may be the scanned biometric information. Additional information regarding biometric scanning, such as fingerprint scanning or hand geometry scanning, is available from International Biometric Group LLC of New York, N.Y. Other biometric identification techniques can be used as well for providing a unique identifier of the player. For example, a microphone can be used in a biometric identification device on the wagering game terminal so that the player can be recognized using a voice recognition system.

In some embodiments, a player can use a telephone to access and use one or more of the player's accumulated game assets. For example, using a mobile phone, the player can dial a toll-free phone number to access his or her game assets. A central server such as the network server 304 (FIG. 3) associated with the network 212 (FIG. 2) can recognize the player's mobile number for identification purposes, via a caller-ID feature, or, alternatively, the central server may require the player to create a unique code number (if, for example, the player uses a caller-ID block feature). Optionally, the player may be required to enter an additional code for identifying a specific wagering game terminal 100.

Thus, the player can use his or her mobile phone to remotely access the wagering game and use the accumulated assets at a time and place according to the player's desire. For example, the player can restart a gaming session via the mobile phone at a point where he or she had previously stopped the session, or the player can choose, via the mobile phone, to play an accumulated bonus game that he or she had previously won, but not played.

In another example, the player can put money into a wagering game terminal 100 while the player is physically at the wagering game terminal 100. Before the player walks away from the wagering game terminal 100, the player can register the wagering game terminal 100 to the player's phone. The player can also let the wagering game terminal 100 know what assets it may intend to use in the future via remote access by the phone. For example, the player can register the phone number as a password required to access the player's assets on the wagering game terminal 100. The player can initiate an auto-play feature while at the wagering game terminal 100 or remotely via the phone. The auto-play feature of the wagering game terminal 100 is configured to report (e.g., via still or moving images on the phone) one or more of the gaming outcomes. Then, at a later time, the player returns to the wagering game terminal 100, re-checks into the wagering game terminal 100 via the phone and, optionally, cashes out any winnings. While no actual game play occurs on the phone, the phone is used for accessing the player's assets and gaming outcomes on the wagering game terminal 100.

Optionally, the wagering game provides the player with access to accumulated assets and/or certain awards only if the player achieves a "Remote Play Winning Outcome." If the player achieves this outcome (e.g., in a basic or bonus game), then he or she is allowed remote access to one or more of the accumulated assets and/or certain awards. For example, if the player achieves the "Remote Play Winning Outcome," the player can have the option to select a smaller award while the player is physically present at the wagering game terminal 100 or a larger award if the player uses the telephone. In another example, the player may be given the option to play for smaller awards while the player is physically present at the wagering game terminal 100 or for larger awards if the player uses the telephone for game play initiation.

Alternative to using a voice telephone call to initiate a game or to access assets and/or awards, as described above, the player can send a text message. For example, the player can send a special code in the text message to log-in using a special number on the wagering game terminal 100.

For identification purposes, various verification ways can be used. For example, the player can enter the mobile telephone number into the wagering game terminal 100 as a player identification number. When the phone is near, the wagering game terminal 100 can detect it and verify the player identification number (e.g., the mobile number). For example, a receiver can be installed in the wagering game terminal 100 for detecting a mobile identifier (which may include the mobile number) that is periodically transmitted by mobile phones to the nearest mobile base station. Thus, the wagering game terminal 100 would have similar capabilities to the mobile base station.

Alternatively, the wagering game terminal 100 can send a voice or text message to the mobile telephone to verify the player's identification number. For example, the wagering game terminal 100 can send a text message asking the player to reply to the text message using a predetermined code for confirmation purposes. Optionally, a Bluetooth™ identifier can be used for logging-in and/or verification purposes, wherein the Bluetooth™ identifier is unique per phone and/or service carrier.

Special benefits can be offered to a player based on the telephone brand and/or service carrier. For example, predetermined assets can be made available to the player only if they use a telephone of brand X that uses service carrier Y. Optionally, the special benefits can be made available based on the telephone model.

The foregoing allows players at the wagering game terminals 100*a* and 100*b* to store their accumulated game assets for subsequent retrieval. This lets players retain the benefit of their earlier gaming experience in the event the players have to leave the wagering game terminals 100*a* and 100*b*. Following now is a general description of the types of game assets that the players may accumulate and store, along with a few specific examples.

In some embodiments, the types of game assets that the players may accumulate are those items that represent a randomly selected outcome in the wagering game. Examples include cards, reel symbols, dice, and the like. The outcome may or may not be a winning outcome that results in a prize or award to the players (i.e., the collected items may or may not be "pay" items). In most cases, the items collected are related to a particular game theme. Examples include stamps in a stamp collection, fruits in a fruit basket, beverages in a cooler, lures in a tackle box, and so on. Individual items (e.g., a card, reel symbol) as well as groups of items (e.g., a hand of cards, symbol combination) may be collected. It is also possible to track the number of times a single item appears in a certain location as opposed to collecting multiple items. These items and groups of items may be tracked and collected over multiple gaming sessions and across multiple wagering game terminals 100*a* and 100*b*, in accordance with embodiments of the invention.

When a predetermined number or set of items have been collected, the player may be awarded a special event game, such as a monetary award (e.g., a jackpot), an unusual bonus game, a certain number of free spins, a temporary increase in features (e.g., extra wild symbols for five consecutive spins), and the like. The special event games may vary according to the number/types of items collected. For example, collecting groups of items may result in higher monetary awards than collecting individual items, collecting a larger set of individual items may result in more free spins than collecting a smaller set of individual items, and so on. Thereafter, the collection may be reset so that the player has to start collecting the items again from the beginning.

In some embodiments, each time the same collection is completed, the special event game awarded for that collection may be enhanced. For example, where the special event game is a "spin until you win" game, the first time around may result in a 10× multiplier of the player's winnings, the second time around a 20× multiplier, the third time a 50× multiplier, and so on. In addition, once a collection is completed, the volatility of the wagering game may be increased. For example, certain symbols may be made less likely to appear once a collection is completed so that it is more difficult to complete the same collection again, but the reward for a subsequent collection is greater so that the overall percentage payback is maintained at a predetermined average. It is also possible to collect multiple different collections in the same wagering game, with each subsequent collection more difficult to complete than the previous collection, but also having a greater prize than the previous collection.

In other embodiments, the player may be given the option of increasing the volatility himself, for example, by choosing to remove certain items (e.g., bar symbols, wildcards, etc.) from the wagering game. In still other embodiments, the player may be given a time limit or a reduced amount of time to complete subsequent collections after the initial collection is completed in order to make the later collections more difficult.

Figure 4A:
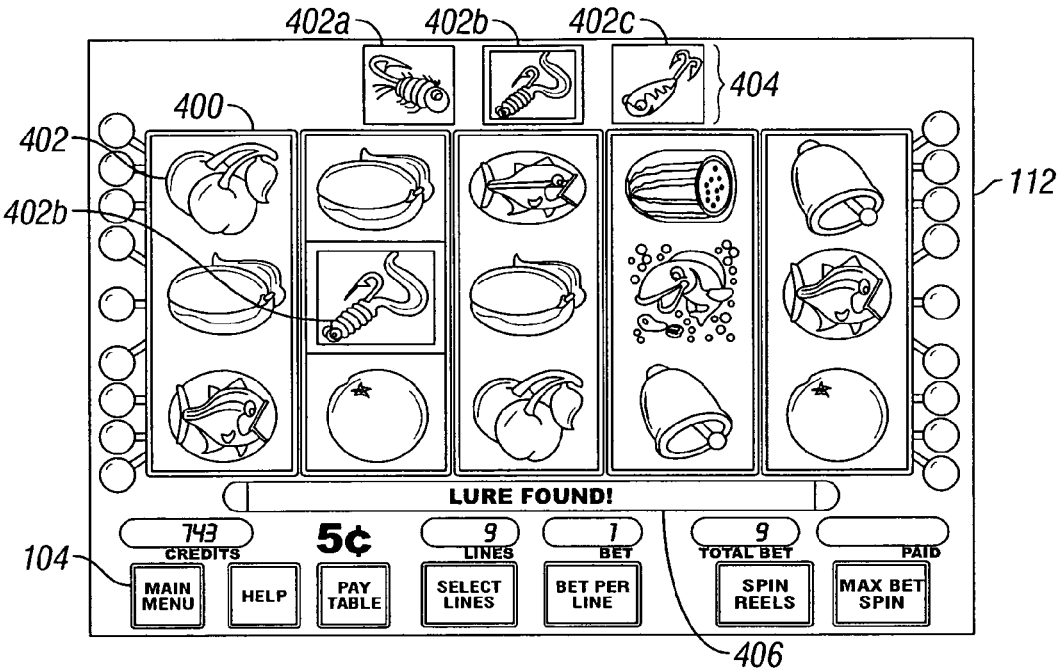
FIGS. 4A-4B illustrate a wagering game where preselected symbols are collected according to one embodiment of the invention.
Figure 4B:
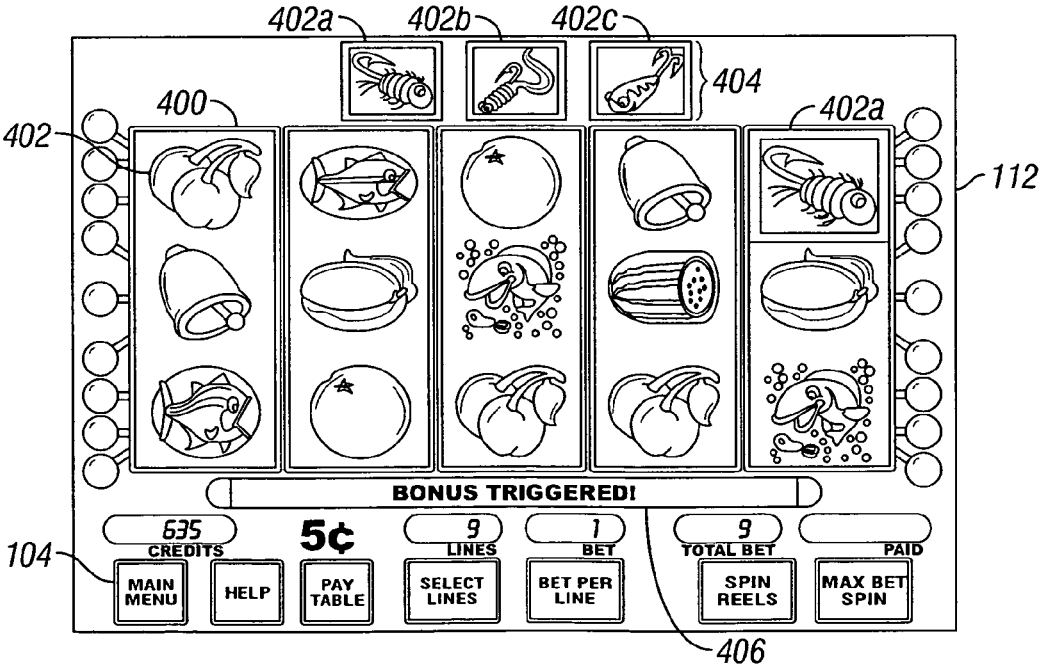

An exemplary game that may be played on the main display 112 of the wagering game terminal 100*a* or 100*b* will now be described with respect to FIGS. 4A-4B. The exemplary wagering game described here is a video slot machine that includes a plurality of reels 400, although other types of wagering games may certainly be used. Each reel 400 is composed of a number of symbols 402 that may land in various combinations to represent the randomly selected outcome of the game. Some of the symbols 402 may be designated as special event symbols 402*a*-402*c* that trigger a special event game, such as a jackpot or a bonus game. These special event symbols 402*a*-402*c* may be identified in a special event area 404, for example, on top of the reels 400 or in some other convenient location.

When one of the special event symbols 402*a*-402*c* appears on the reels 400 as part of the representation of the randomly selected outcome, the player collects that special event symbol 402*a*-402*c*. This may be indicated by highlighting or otherwise emphasizing the special event symbol 402*a*-402*c* in the special event area 404 and/or announcing the collection of the special event symbol 402*a*-402*c* in an announcement area 406.

The special event symbols 402*a*-402*c* may be permitted to appear anywhere on the reels 400, or they may be required to appear only on a particular reel 400 and/or a particular reel position in order to be awarded. The former case is illustrated in FIG. 4A, where the randomly selected outcome of the wagering game results in the second special event symbol 402*b* appearing on the second reel 400. That particular special event symbol 402*b* is then highlighted in the special event area 404 to indicate that it has now been collected by the player. When the player accumulates all of the special event symbols 402*a*-402*c*, he or she is awarded a special event game, such as a jackpot or a bonus game, by the wagering game terminal 100*a* or 100*b* (or by the network 212).

In accordance with embodiments of invention, if the player decides to cash out, he or she has the option of saving any special event symbols 402*a*-402*c* accumulated up to that point. The player may do so, for example, by using the TITO system described above. When the player subsequently returns to the same or a different wagering game terminal 100*a* or 100*b*, he or she may use the TITO system to retrieve his or her accumulated special event symbols 402*a*-402*c*. The player may then resume collecting special event symbols 402*a*-402*c* from the point where he or she left off, thus retaining the benefit of the earlier gaming session. Such an arrangement allows the player to complete his or her collection of special event symbols 402*a*-402*c* more quickly than if the player were to start over from the beginning. FIG. 4B illustrates an example of a completed collection, where all the special event symbols 402*a*-402*c* in the special event area 404 are highlighted and an appropriate message is displayed in the announcement area 406.

Being able to retain the benefit of earlier: gaming sessions is especially advantageous when the player is competing against other players at other wagering game terminals 100*a* and 100*b* on the network 212 (or against an imposed time limit). In that case, players with faster collection completion times may be awarded higher prizes. It is also possible for players to collaborate on the same collection, the completion of which results in all collaborating players being awarded a special event game. In some instances, the collaboration and competition may be combined so that all collaborating players are awarded the special event game, but the players who contribute a higher number of special event symbols to the collection receive enhancements to their special event game (e.g., extra spins, higher multipliers, etc.).

In some embodiments, the player may transfer his or her accumulated special event symbols 402*a*-402*c* to another player, for example, by directly/indirectly giving/selling his or her ticket to the other player. The other player may then retrieve the accumulated special event symbols 402*a*-402*c* at one of the wagering game terminals 100*a* or 100*b* using the ticket.

Figure 5A:
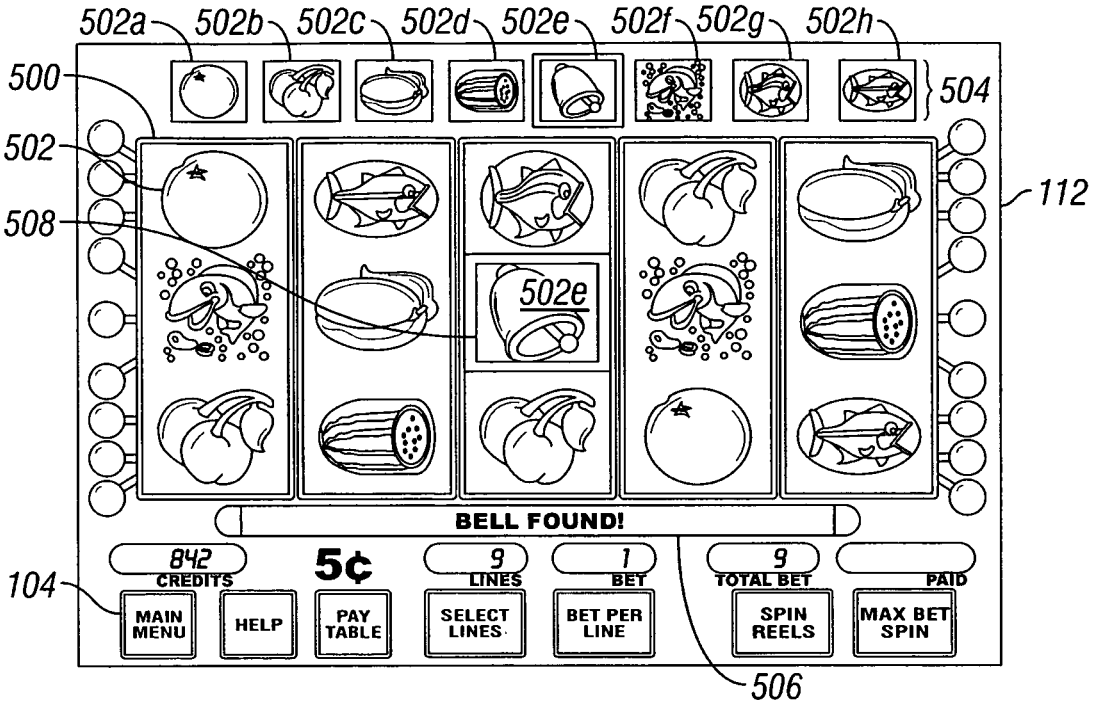
FIGS. 5A-5B illustrate a wagering game where all symbols are collected according to one embodiment of the invention.
Figure 5B:
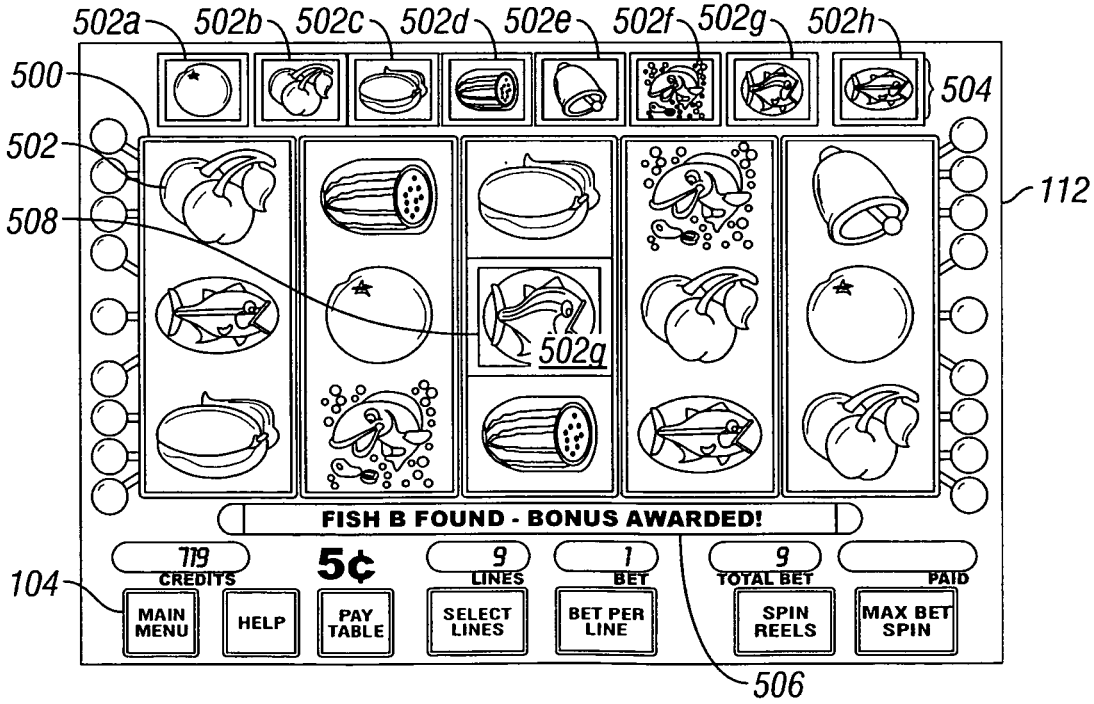

FIGS. 5A-5B illustrate another exemplary wagering game where the player may retain the benefit of his or her earlier gaming session. The wagering game of FIGS. 5A-5B is similar to the wagering game of FIGS. 4A-4B in that it involves a plurality of reels 500, each reel 500 composed of a number of symbols 502. There are, however, a few differences. First, instead of only a handful of the symbols 500 being designated as special event symbols, all of the symbols 502 are designated as special event symbols 502*a*-502*h*. These special event symbols 502*a*-502*h* may be identified in a special event area 504, and their collection may also be announced in an announcement area 506. Second, only those special event symbols 502*a*-502*h* that appear at a particular reel 500 and/or a particular reel position are collected by the player. In the embodiment shown here, only special event symbols 502*a*-502*h* appearing in the middle position 508 of the middle reel 500 are collected by the player. In other embodiments, however, the position 508 of the special event symbols 502*a*-502*h* may be required to be at a different reel/reel position, and/or may be randomly selected so that the position 508 changes with each round of the wagering game.

Once the player collects all the special event symbols 502*a*-502*h*, he or she is awarded a special event game, such as a jackpot or a bonus game, by the wagering game terminal 100*a* or 100*b* (or by the network 212). This is illustrated in FIG. 5B, where all the special event symbols 502*a*-502*h* in the special event area 504 are highlighted to indicate that they have been collected. As before, if the player decides to cash out at any time before he or she completes the collection, the player has the option of retaining the special event symbols 502*a*-502*h* accumulated up to that point. The player may do so, once again, by using the TITO system described above. When the player subsequently returns to the same or a different wagering game terminal 100*a* or 100*b*, he or she may use the TITO system to retrieve the accumulated special event symbols 502*a*-502*h*. The player may then resume collecting special event symbols 502*a*-502*h* from the point where he or she left off.

Figure 6A:
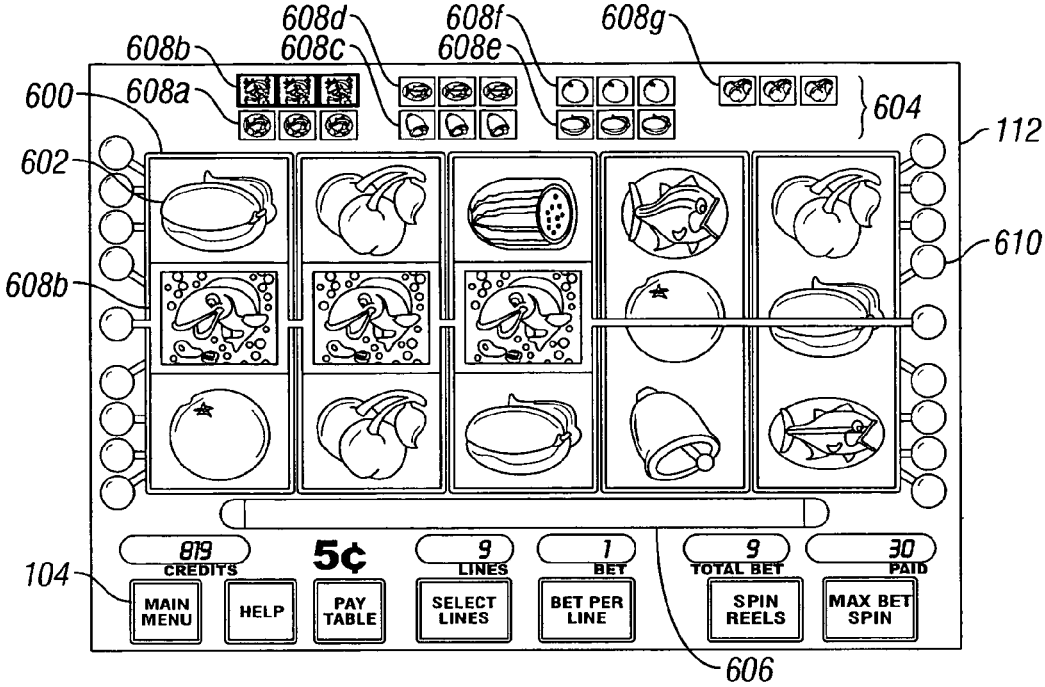
FIGS. 6A-6B illustrate a wagering game where symbol combinations are collected according to one embodiment of the invention.
Figure 6B:
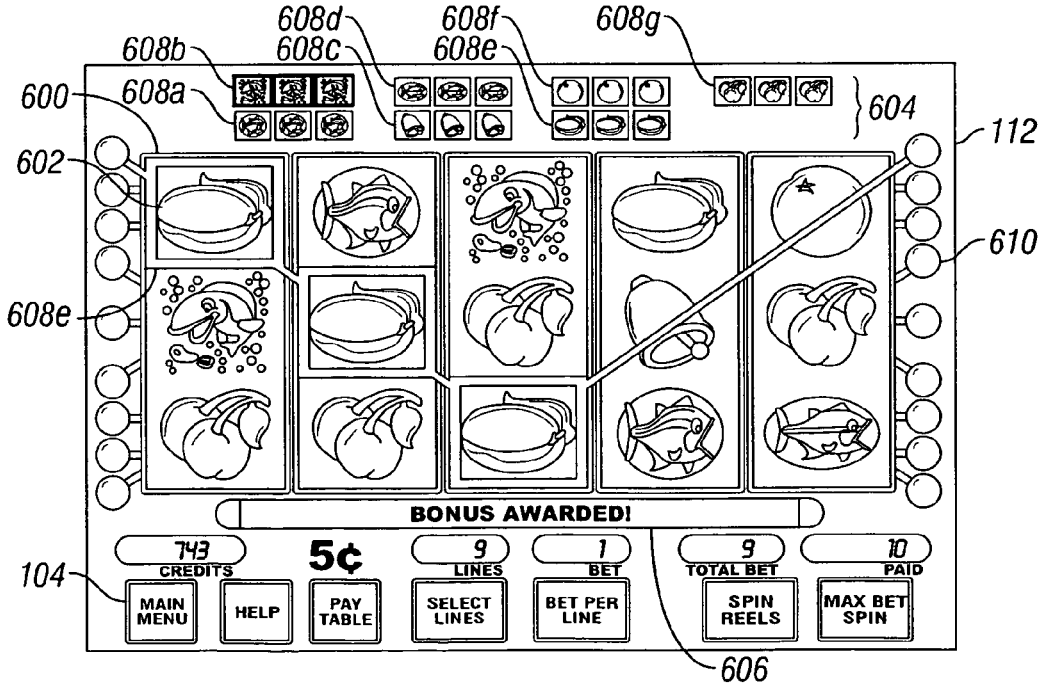

In some embodiments, rather than collect individual special event symbols, the wagering game may require the player to collect special event combinations. An example of such a wagering game is illustrated in FIGS. 6A-6B. Here, the special event combinations 608*a*-608*g* (identified in the special event area 604) are defined as at least three occurrences of the same symbol 602 in a payline for all symbols 602 on the reels 600. The paylines are indicated by the payline indicators 610. Thus, each time a 3-symbol payline hits (representing a winning outcome), the player collects the particular special event combination 608*a*-608*g* making up that payline. In addition, the occurrence of three of the same symbol 602 in a 4-symbol payline or a 5-symbol payline, while not necessarily a winning outcome, also results in the player collecting the special event combination 608*a*-608*g* in those paylines.

As with the previous embodiments, if the player decides to cash out before he or she collects all of the special event combinations 608*a*-608*g*, the player has the option of retaining the special event combinations 608*a*-608*g* collected up to that point. For example, in FIG. 6A, the randomly selected outcome of the wagering game has resulted in the second special event combination, labeled 608*b*, appearing in a payline. The special event combination 608*b* is highlighted in the special event area 604, and an announcement is also displayed (in some cases) in the announcement area 606, to indicate that it has been collected by the player. If the player were to cash out at this point, he or she has the option of retaining this special event symbol combination 608*b* until a later gaming session. FIG. 6B shows an example of a completed set of special event combinations 608*a*-608*g*, resulting in the player being awarded a special event game, such as a bonus game or a jackpot, by the wagering game terminal 100*a* or 100*b* (or by the network 212).

Note that, as it turns out, this particular payline is a 3-symbol payline and, therefore, is indicative of a winning outcome. However, the payline could have been a 4-symbol payline or a 5-symbol payline, which are not winning paylines, but for which the player would still have collected the special event combination 608*b*. It is of course possible to define the special event combination 608*a*-608*g* as exactly three of the same symbol 602 in a payline so that four or more of the same symbol 602 in a payline would not constitute a special event combination 608*a*-608*g*.

Figure 7:
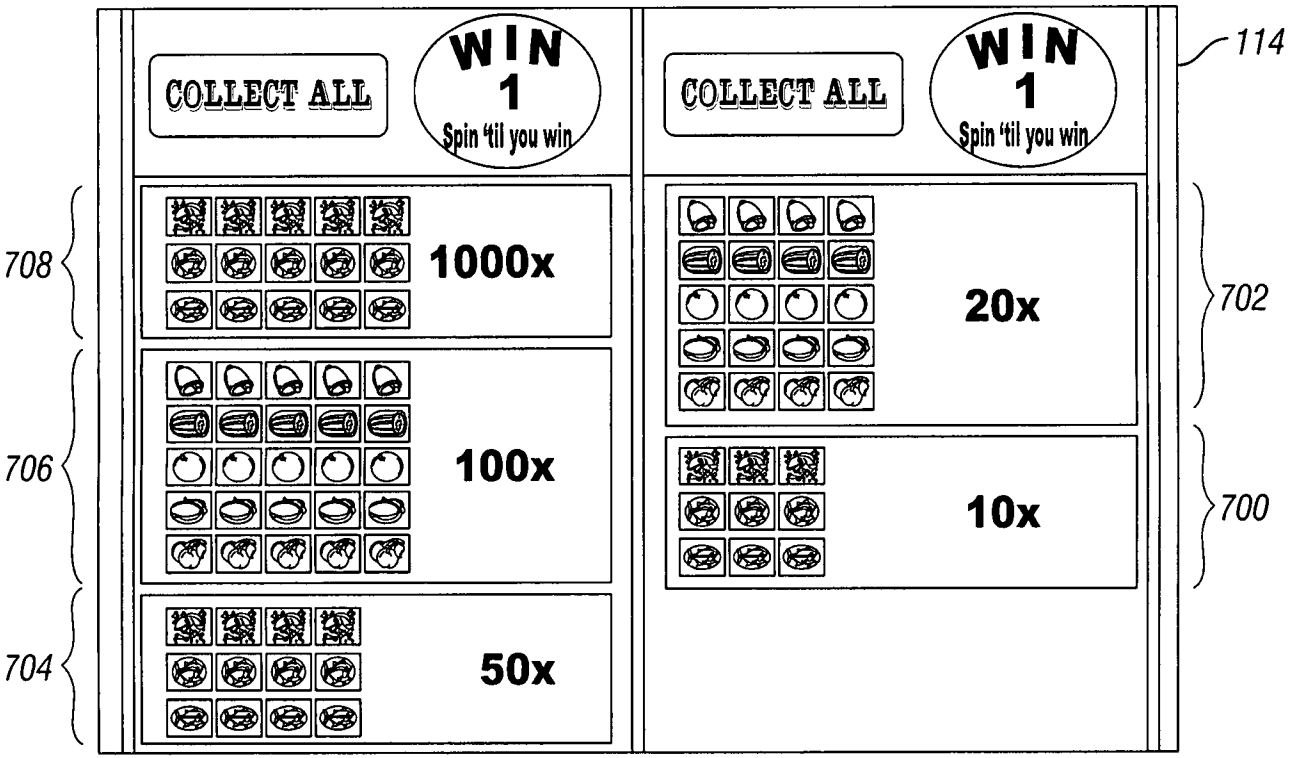
FIG. 7 illustrates a wagering game where different sets of symbol combinations are collected according to one embodiment of the invention.

In some embodiments, in addition to 3-symbol combinations, the wagering game may also count 4-symbol and 5-symbol combinations as special event combinations. Stated another way, the special event combinations may be all the "pay" combinations that are indicative of a winning outcome. Then, depending on the special event combinations he or she has collected, the player may be awarded different special event games or variations of the same special event game. These embodiments may be better understood by reference to the pay table shown in FIG. 7. As can be seen here, the pay table, which is typically displayed on the secondary display 114, defines five sets of special event combinations 700, 702, 704, 706, and 708. These special event combinations 700, 702, 704, 706, and 708 represent all the "pay" combinations that indicate a winning outcome in the wagering game. The first set of special event combinations 700 includes three 3-symbol combinations. If the player manages to collect all three of these 3-symbol combinations, he or she is awarded a special event game, for example, the "spin until you win" bonus game (if the wagering game is a slot machine game). The next two sets of special event combinations 702 and 704 are 4-symbol combinations, and the last two special event combinations 706 and 708 are 5-symbol combinations. In accordance with embodiments of the invention, each one of these special event combinations 702-708 may have a different multiplier, as shown. For example, the first set of special event combinations 700 may have a multiplier of 10×, the second set 702 a multiplier of 20×, the third set 704 a multiplier of 50×, and so on through the pay table as shown.

Figure 8A:
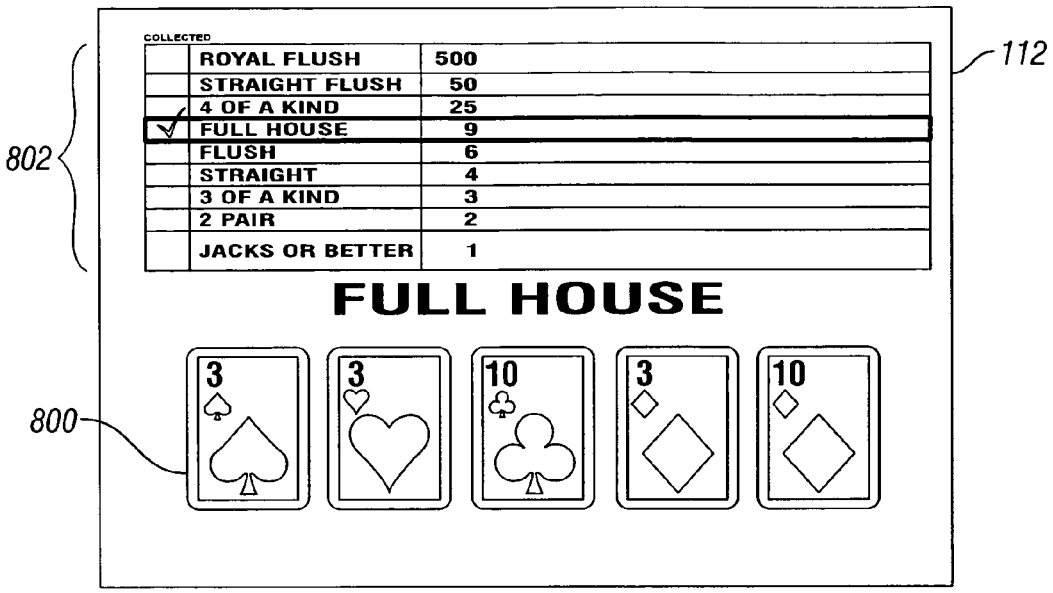
FIGS. 8A-8B illustrate another wagering game where different sets of symbol combinations are collected according to one embodiment of the invention.
Figure 8B:
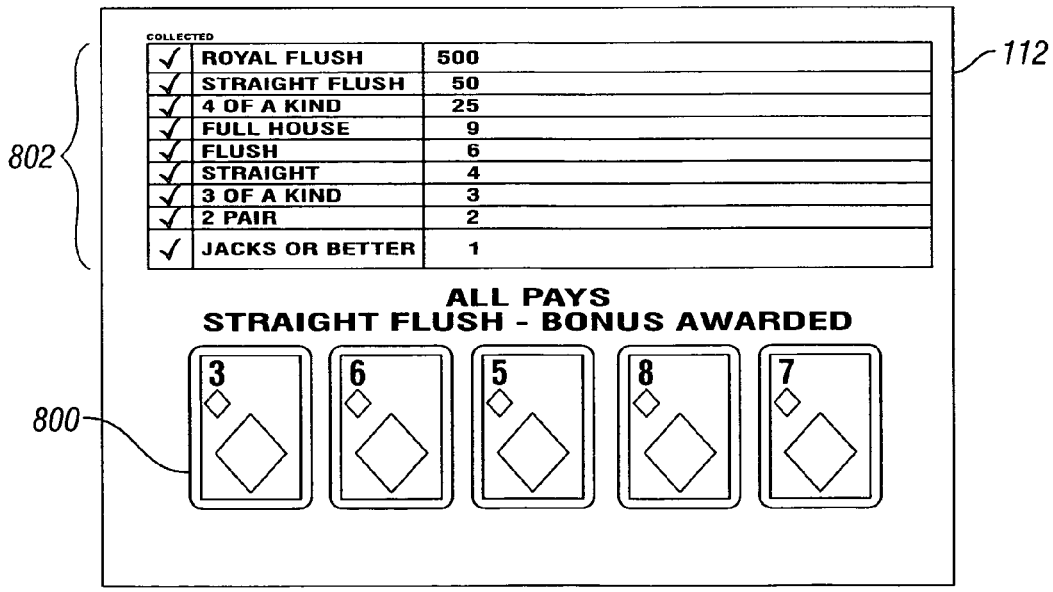

Although embodiments of the invention have been described thus far with respect to slot machine wagering games, the invention is not to be limited thereto. For example, the principles and teachings of the invention may be equally applied to card games. An exemplary card game according to embodiments of the invention is illustrated in FIGS. 8A-8B. The card game shown here is a poker game where the player is dealt a hand of cards 800. A pay table 802 displays the various card combinations along with the corresponding credit amounts awarded to the player for achieving one of the card combinations.

In the example shown here, the card combinations include a royal flush, a straight flush, four of a kind, a full house, a flush, a straight, three of a kind, two pairs, and jacks or better. Each time the player achieves one of the listed combinations, the player is awarded the corresponding credit amount, and a checkmark is placed next to that combination in the pay table 802. When the player has achieved all of the listed combinations, he or she is awarded a special event game, such as a bonus game for jackpot, by the wagering game terminal 100*a* or 100*b* (or by the network 212). This is illustrated in FIG. 8B, where a checkmark has been placed next to all of the combinations in the pay table 802. As before, if the player cashes out before completing his or her collection, the player has the option of retaining the card combinations accumulated thus far and resuming the collection activity at a later time.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A wagering game terminal, comprising:

a wager input device for receiving wager inputs at said wagering game terminal, said wagers applied to a wagering game in which outcomes are randomly selected from a plurality of outcomes; and a display for displaying symbols indicative of each randomly selected outcome, said symbols including different special event symbols that are added to a special event collection associated with a player in response to said special event symbols being displayed on said display in a predetermined manner, said special event collection triggering a special event on said wagering game terminal when complete, wherein said special event collection is complete when a predetermined combination of said different special event symbols have been added to said special event collection;

wherein said wagering game terminal is configured to store said special event symbols that have been added to said special event collection upon conclusion of a current gaming session associated with the player and to restore said previously stored special event symbols to said special event collection in a subsequent gaming session associated with the player.

2. The wagering game terminal according to claim 1, wherein said special event collection is complete when all of said special event symbols have been added to said special event collection.

3. The wagering game terminal according to claim 1, wherein said special event collection is complete when a predetermined number of said special event symbols have been added to said special event collection.

4. The wagering game terminal according to claim 1, wherein said special event symbols are part of card symbol combinations displayed as one or more of: a royal flush, a straight flush, a four of a kind, a full house, a flush, a straight, a three of a kind, two pairs, or a jacks or better.

5. The wagering game terminal according to claim 1, wherein said special event includes a monetary award being given to a player at said wagering game terminal.

6. The wagering game terminal according to claim 1, wherein said special event includes a bonus game being given to a player at said wagering game terminal.

7. The wagering game terminal according to claim 1, wherein said special event includes an enhancement to a feature of said wagering game terminal.

8. The wagering game terminal according to claim 1, wherein said special event includes an increase in a payout of said wagering game terminal.

9. The wagering game terminal of claim 1, wherein said wagering game terminal is configured to store said special event symbols to an account accessible to the player.

10. The wagering game terminal of claim 1, wherein said previously stored special event symbols comprise said special event symbols stored upon said conclusion of said current gaming session.

11. The wagering game terminal according to claim 1, wherein the award is a special event.

12. The wagering game terminal according to claim 1, wherein the special event combinations comprise at least three special event symbols.

13. The wagering game terminal according to claim 12, wherein the special event combinations comprise at least three occurrences of the same special event symbol.

14. A method of operating a wagering game system, comprising:

accepting wagers at a wagering game terminal, said wagers applied to a wagering game in which outcomes are randomly selected from a plurality of outcomes;

displaying symbols indicative of each randomly selected outcome on a display, said symbols including different special event symbols;

adding said different special event symbols to a special event collection if said different special event symbols are displayed on said display in a predetermined manner;

storing said special event symbols that have been added to said special event collection upon conclusion of a current gaming session;

removing said special event symbols from said display upon the conclusion of the current gaming session;

restoring said previously stored special event symbols to said special event collection in a subsequent gaming session and displaying the restored special event symbols in the subsequent gaming session; and triggering a special event on said wagering game terminal when said special event collection is complete in said subsequent gaming session, wherein said special event collection is complete when a predetermined combination of said different special event symbols have been added to said special event collection.

15. The method according to claim 14, wherein said predetermined manner includes said special event symbols being displayed in any combination that is indicative of a winning outcome.

16. The method according to claim 14, wherein said wagering game includes a plurality of reels and said predetermined manner includes individual special event symbols being displayed anywhere on said reels.

17. The method according to claim 14, wherein said wagering game includes a plurality of reels and said predetermined manner includes individual special event symbols being displayed in a specific location on said reels.

18. The method according to claim 14, wherein said wagering game includes a plurality of reels and said predetermined manner includes any special event symbol being displayed in a row of three on said reels.

19. The method according to claim 14, wherein said wagering game includes a plurality of reels and said predetermined manner includes said special event symbols being displayed in a payline of said wagering game.

20. The method according to claim 14, wherein said special event symbols are card symbols and said predetermined manner includes said card symbols being displayed as one or more of: a royal flush, a straight flush, a four of a kind, a full house, a flush, a straight, a three of a kind, two pairs, and a jacks or better.

21. The method of claim 14, wherein the storing comprises storing said special event symbols to an account accessible to the player.

22. The method of claim 14, wherein said previously stored special event symbols comprise said special event symbols stored upon said conclusion of said current gaming session.

23. The method of claim 14, wherein the previously stored special event symbols were previously stored at a second wagering game terminal.

24. The method of claim 14, wherein the award is a special event.

25. The method of claim 14, further comprising:

displaying symbols indicative of a randomly selected outcome to another player, said symbols including special event symbols; and adding said special event symbols to the special event collection if said special event symbols are displayed in a predetermined manner, wherein the special event collection is associated with both players; and wherein the special event is triggered for the another player.

26. A method of operating wagering game terminals, comprising:

displaying symbols indicative of a randomly selected outcome, said symbols including different special event symbols;

adding said different special event symbols to a special event collection associated with a player if said special event symbols are displayed in a predetermined manner;

completing said special event collection associated with the player over multiple gaming sessions without restarting said special event collection, wherein the gaming sessions are associated with the player; and triggering a special event on a wagering gaming terminal of said wagering game terminals when said special event collection is complete, wherein said special event collection is complete when a predetermined combination of said different special event symbols have been added to said special event collection.

27. The method of claim 26, further comprising storing said special event symbols that have been added to said special event collection to an account accessible to the player.

28. The method of claim 26, wherein completing said special event collection over multiple gaming sessions without restarting said special event collection comprises completing said special event collection over multiple wagering game terminals.

29. A computer-readable storage medium encoded with instructions for causing a computer to perform a method comprising:

displaying symbols indicative of a randomly selected outcome, said symbols including different special event symbols;

adding said different special event symbols to a special event collection associated with a player if said special event symbols are displayed in a predetermined manner;

completing said special event collection associated with the player over multiple gaming sessions without restarting said special event collection, wherein the gaming sessions are associated with the player; and triggering a special event on a wagering game terminal when said special event collection is complete, wherein said special event collection is complete when a predetermined combination of said different special event symbols have been added to said special event collection.

* * * * *